United States Patent [19]

Gluckin

[11] 4,386,990

[45] Jun. 7, 1983

[54] METHOD OF MAKING A MOLDED BRASSIERE CUP

[76] Inventor: Gerald Gluckin, 440 E. 57 St., New York, N.Y. 10022

[21] Appl. No.: 321,441

[22] Filed: Nov. 16, 1981

[51] Int. Cl.[3] ..... A41C 3/14; B29C 3/00

[52] U.S. Cl. ..... 156/245; 156/257; 156/308.4; 264/258; 264/152; 128/477; 128/492

[58] Field of Search ..... 156/245, 242, 273, 287, 156/257, 264, 265, 308.4; 264/258, 152; 128/465, 463, 464, 477, 474, 493, 492, 489, 491; 2/255, 78 D, 78 C, DIG. 1

[56] References Cited

U.S. PATENT DOCUMENTS 199,027 1/1878 Bullock ..... 128/492

3,221,747 12/1965 Blair ..... 128/492

4,172,002 10/1979 Gluckin ..... 156/245

FOREIGN PATENT DOCUMENTS 451713 9/1949 Italy ..... 2/DIG. 1

*Primary Examiner*—Edward C. Kimlin

*Assistant Examiner*—Louis Falasco

[57] ABSTRACT

In the method of U.S. Pat. No. 4,172,002, a support patch and brassiere fabric both must have the requisite stretch to stay in conforming changing shapes during the molding thereof into a three-dimensional cup shape, such that said same or conforming shapes of each in the molded product are devoid of wrinkles or the like. As an improvement to the patented method, the within support patch is prepared to assume an increase in size without stretching, thereby enabling even non-stretch fabrics to be used as a support attachment for a molded brassiere cup.

1 Claim, 10 Drawing Figures

METHOD OF MAKING A MOLDED BRASSIERE CUP

The present invention generally relates to molded brassiere cups with attached support patches of the type, for example, of U.S. Pat. No. 4,172,002, and more particularly to improvements in the preparation of the support patch which enables the use of non-stretch fabrics for this molded brassiere cup component.

As explained in U.S. Pat. No. 4,172,002, a molded brassiere cup can be produced with a support patch, without any wrinkles in said support patch, if during molding both these fabric components are made to assume the identical three-dimensional shape. Thus, both fabric components, according to the patented method, were selected from stretch fabrics that during molding could be stretched from the flat into a cup shape of the requisite increased size.

While the moldable brassiere fabric because of its external position is readily constituted by the available stretch fabrics, the internal position of the adhered support patch requires a soft, comfortable surface that is not as readily satisfied by these fabrics. For example, flocking of a fabric provides an ideal soft and comfortable-to-the-touch surface for a support patch, but this also obviates any stretch therein, such that it could not be readily used in practicing the method of U.S. Pat. No. 4,172,002.

Broadly, it is an object of the present invention to significantly remove the restrictions on the fabrics usable for molded brassiere cups, thereby overcoming the foregoing and other shortcomings of the prior art. Specifically, it is an object to embody the support attachment fabric component with a size-increasing capability so it can assume a shape conforming to that of the brassiere fabric component, but not by stretching, thereby significantly increasing the types of fabrics that can be used for this function.

Using basically the method patented in U.S. Pat. No. 4,172,002, wherein the parameters for producing the desired end product contemplate molding a fabric brassiere cup with a support fabric in attached relation thereto in which said support fabric and said fabric brassiere cup are initially adhered to each other in the flat and thereafter both correspondingly expand in size incident to being molded into a three-dimensional shape of a brassiere cup, the improvements thereto demonstrating objects and advantages of the present invention include the steps of preparing said support fabric with selected incisions therein so as to delineate said fabric on opposite sides of the edges bounding each said incision into separating parts. Next, and following the patented method, there is adhered an initial-sized piece of prepared support fabric to said fabric brassiere cup while both said fabrics are in the flat. During molding of said adhered fabrics into a three-dimensional brassiere cup shape, the edges bounding each said incision of said support fabric separate from each other to allow for the increase in said size of said support fabric as it assumes the three-dimensional shape that is imparted to the fabric brassiere cup. Thus, due to the preparation above noted a support fabric with even only nominal stretch is usable as a support attachment for a molded brassiere cup.

The above brief description, as well as further objects, features and advantages of the present invention, will be more fully appreciated by reference to the following detailed description of presently preferred, but nonetheless, illustrative embodiments of components for practicing the within described method in accordance with the present invention, when taken in conjunction with the accompanying drawings, wherein:

FIG 1A is a perspective view of a molded brassiere cup with a support fabric patch attached thereto;

FIG. 1B is a partial front elevational view of the prior art brassiere cup as it would be seen from the front when in use, in which there is illustrated the stretch patterns of the fabric components thereof; and FIG. 1C is a side elevational view projected from FIG. 1B showing further details of the performance requirements imposed on the brassiere cup during use.

Figure 2A:
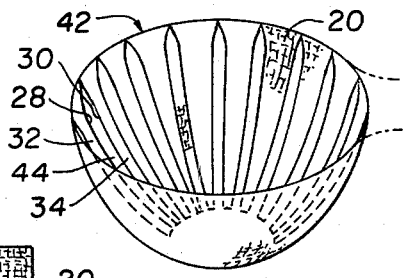
Figure 2B:
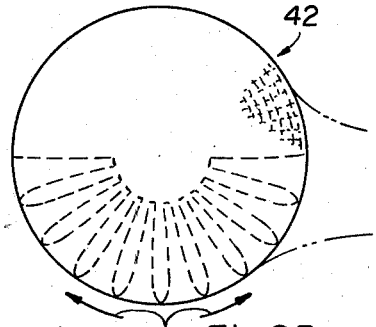
Figure 2C:
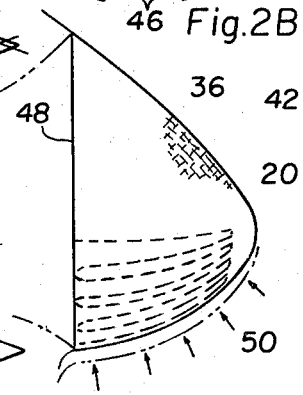

FIGS. 2A, 2B and 2C are similar to the prior art figures just described, but illustrate a molded brassiere cup using a support attachment that is specifically adapted for practicing the within inventive method in making a molded brassiere cup. More particularly, there is illustrated a perspective, front elevational and side elevational view in FIGS. 2A, 2B and 2C, respectively, of a molded brassiere cup with a support fabric attachment thereto which is comprised of a construction material that has nominal or little stretch, yet readily assumes a three-dimensional cup shape.

Figure 3A:
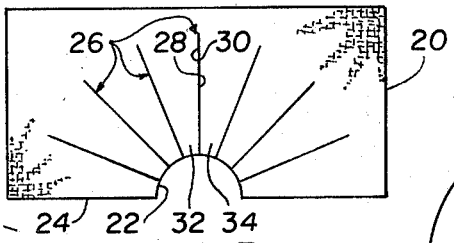
Figure 3B:
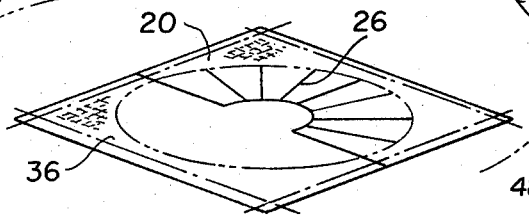
Figure 3C:
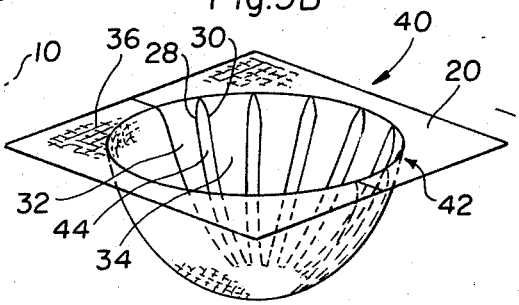

FIGS. 3A, 3B and 3C are intended to illustrate, by progressive examination, one preferred method of preparing a support attachment for a molded brassiere cup in accordance with the present invention. More particularly, FIG. 3A is an isolated plan view of the prepared support fabric in the flat;

FIG. 3B is a perspective view illustrating said support fabric of FIG. 3A and also a moldable brassiere cup fabric in an adhered relation to each other; and FIG. 3C is a perspective view illustrating the adhered fabrics of FIG. 3B after the molding thereof into a three-dimensional brassiere cup shape.

Figure 4:
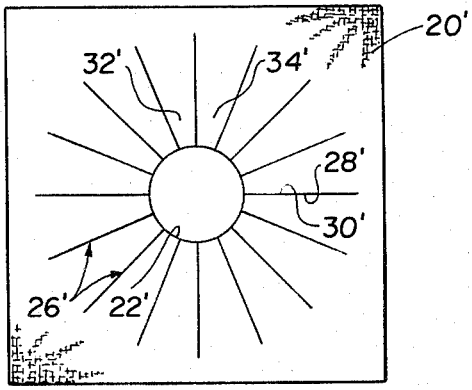

Remaining FIG. 4 is a plan view similar to FIG. 3A, but illustrating another contemplated method of preparing a support attachment for a molded brassiere cup.

The within methods of producing a molded brassiere cup with support attachments contemplate significant improvements over applicant's already patented method of U.S. Pat. No. 4,172,002 of producing the brassiere cup product referred to. However, the patented method of U.S. Pat. No. 4,172,002 is limited to the use of a "moldable" support fabric, by which is meant that such fabric is required to be capable of stretch under pressure and heat so that it can assume an increase in size during its transformation from the flat into a three-dimensional cup shape that is characteristic of a brassiere cup. Although there is a wide range of fabrics that can be selected that can embody the physical parameters of stretch noted above, it is nevertheless desirable to be able to use a support fabric that does not have to stretch when being molded into a three-dimensional brassiere cup shape. As but one example, a support fabric usable in accordance with the present invention might include a fabric that is "flocked" to provide a soft and more comfortable surface, even though the flocking procedure substantially obviates any stretch in the support fabric. As used herein, it will be understood that the support fabric is of a construction material that does not include plastic or elastomeric yarns and thus has little or nominal "moldability" or stretch.

Figure 1A:
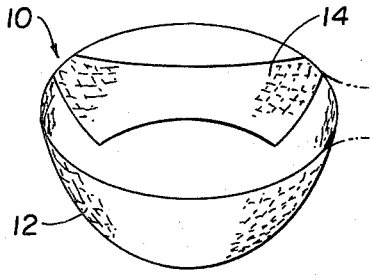
Fig.1A PRIOR ART
FIGS. 1A, 1B and 1C illustrate a prior art-produced molded brassiere cup and serves as useful background in understanding the improved method of the present invention. More particularly.
Figure 1B:
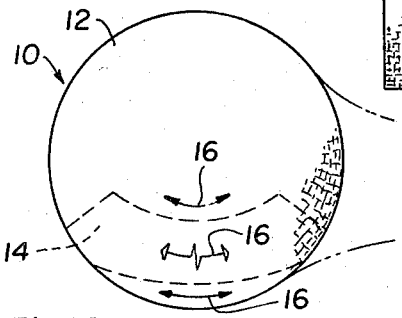
Fig.1B PRIOR ART

As understood, it is already well known how to produce a three-dimensional brassiere cup by molding the fabric from the flat into this shape using a fabric having the requisite physical characteristics which enable it to increase in size during its transformation from the flat into said three-dimensional cup shape. One such method is illustrated and described in U.S. Pat. No. 4,172,002 which, by this reference, is incorporated herein in its entirety. For both completeness and convenience, a brief description of a typical prior art method of producing a molded brassiere cup with a support fabric attachment will now briefly be described in connection with FIGS. 1A, 1B and 1C. Such prior art molded brassiere cup, generally designated 10, is comprised of a brassiere fabric 12 that, in a well understood manner, is capable of being molded because of its plastic or elastomeric yarn content into the three-dimensional shape of the cup 10. Prior to the molding which produces the cup 10, there is initially adhered to the fabric 12, while it is in the flat, a support fabric that is typically in a patch-size 14. That is, both the fabric 12 and patch 14 are adhered to each other while in the flat and a cup-shaped molding element (not shown), that is usually heated, is projected into the fabrics 12, 14 so to transform or cause, in a well understood manner, said fabrics 12, 14 to assume a three-dimensional brassiere cup shape. During the molding as just briefly described, both the brassiere fabric 12 and the support fabric patch 14 undergo stretching, as illustrated by the reference lines, individually and collectively designated 16, in at least the circumferential directions illustrated, as these fabrics assume a three-dimensional cup shape.

Figure 1C:
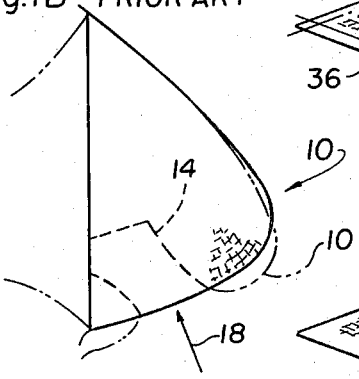
Fig.1C PRIOR ART

As illustrated in FIG. 1C, the resulting molded brassiere cups 10, when worn, provide support for the bosom in that the patch 14 in each offers resistance to sagging movement, as illustrated by the reference arrow 18, with the result that each cup 10 might undergo only a nominal change in position during use, as illustrated by the full line and phantom line positions of movement thereof.

In accordance with the present invention, it is now possible to produce a molded brassiere cup with a support attachment in which the latter is of a fabric construction material that has little or none of the stretch 16 (which heretofore was required) in order to produce a prior art molded brassiere cup with a support patch or the like. To readily understand how this is possible in accordance with the present invention, reference should be made first to FIGS. 3A, 3B and 3C and, more particularly, to progressive examination thereof. Thus, FIG. 3A shows only a ply 20 for fabric that is prepared for use as a support attachment to a molded brassiere cup. The preparation of ply 20 includes die cutting or otherwise removing a semi-circular opening 22 in a central location along edge 24. Next, cuts or incisions are made in the fabric ply 20 in a radial and circumferential arrangement with respect to the opening 22, said incisions being herein individually and collectively designated 26. Thus, each incision 26, and using only one that is centrally located in FIG. 3A has edges 28 and 30, which define or, more accurately bound, each incision 26. This, in turn, produces, again using only the central incision 26 for illustrative purposes, cooperating pie-shaped segments 32 and 34 that include the referred to edges 28 and 30 and, thus, can separate from each other when the edges 28 and 30 separate from each other.

The support fabric ply 20 prepared as just described in connection with FIG. 3A is then adhered to a moldable brassiere fabric ply 36, the adhering of these fabric plies being done in the flat in a well understood manner, as for example, using the technique described and illustrated in detail in U.S. Pat. No. 4,172,002.

The adhered together fabric plies 20 and 36 are then molded, using a well understood molding apparatus and technique which, again, may be similar to that described and illustrated in U.S. Pat. No. 4,172,002 into a three-dimensional brassiere cup shape, as illustrated in FIG. 3C, and generally designated 40 therein. What is particularly significant about the molded cup 40 and illustrated with clarity in FIG. 3C is that adjacent segments 32, 34 readily assume a circumferentially spaced apart orientation about what will be understood to be the lower portion of the brassiere cup per se designated 42, that is removed from the construction 40. More particularly, and as is clearly illustrated, the circumferential spacing just referred to is a result of the edges 28 and 30 of each incision 26 separating from each other by the distance or dimension 44. To put it another way, the cumulative effect of the separations 44 which occur between each adjacent segments 32, 34 as a result of the separation of the edges 28, 30, provides the increase in dimension in the support fabric 20, which provides the necessary increase in size that in the prior art was the result of stretching in order for this fabric component to be able to assume the three-dimensional shape of the brassiere cup, to which it was providing support.

At this point in the description it is convenient to note with reference to FIG. 4, another preferred method of preparing a support fabric for use in attached relation to a molded brassiere cup. The structural features of the ply illustrated in FIG. 4 that are similar to those already described in connection with FIG. 3A are designated by the same, but primed reference numerals. The only significant difference between the support fabric plies 20 and 20' is that the central opening 22' of the latter is a complete circle, rather than only a half or semi-circle, such as is used for ply 20.

For completeness' sake, the manner in which the support attachment 20 functions in a molded brassiere cup will now be briefly described in connection with FIGS. 2A, 2B and 2C. More particularly, molded cup 42 is supported in that portion that in use is the lower or underside portion of the cup by an attached or adhered support patch 20 that has expanded in a circumferential dimension as a result of the individual segments 32, 34 separating from each other a distance 44 as a result of the separating movements of the edges 28, 30 of each radial incision 26.

The cumulative separating movements are illustrated in FIG. 2 by reference arrow 46.

The result, as illustrated in FIG. 2C, is that the support attachment 20 expands circumferentially along with this direction of expansion in the brassiere fabric 36 during the molding thereof from the flat into a three-dimensional cup shape. An additional benefit achieved which is best illustrated in FIG. 2C is that the suppport attachment 20 extends a greater distance forward of the rear cup edge 48 than the prior art configuration and, thus, correspondingly provides an increased line of support 50 for the improved molded brassiere cup 42 hereof.

A latitude of modification, change and substitution is intended in the foregoing disclosure and, in some instances, some aspects of inventive method hereof will be employed without a corresponding use of other aspects. Accordingly, it is appropriate that the appended claims be construed broadly and in a manner consistent with the spirit and scope of the invention herein.

What is claimed is:

1. An improvement in molding a stretch fabric brassiere cup with a support fabric in attached relation thereto in which said support fabric and said fabric brassiere cup are initially adhered to each other in the flat and thereafter both correspondingly expanded in size incident to being molded into a three-dimensional shape of a brassiere cup, the improvement comprising the steps of preparing a non-stretch support fabric by making a semi-circular opening in an edge of said support fabric, orienting plural incisions in radial relation to said semi-circular opening and in circumferentially spaced relation thereabout thereby forming edges which bound the incisions, and positioning said support fabric semi-circular opening in a central location of said brassiere cup, adhering said prepared piece of support fabric to said fabric brassiere cup using heat while both said fabrics are in the flat, and molding said adhered fabrics insubstantial conformance with each other into a three-dimensional brassiere cup shape during which said edges bounding said radially oriented incisions of said support fabric separate from each other into a semi-circular shape to allow for the increase in said size of said support fabric as it assumes said three-dimensional shape of said fabric brassiere cup, whereby a support fabric with even only nominal stretch is usable as a support attachment for a molded brassiere cup.

* * * * *